US005720668A

United States Patent [19]

Brett

[11] Patent Number: 5,720,668

[45] Date of Patent: Feb. 24, 1998

[54] GOLF CLUB VISUAL ALIGNMENT MEANS

[76] Inventor: Colin E. Brett, 740 123rd Ave., Treasure Island, Fla. 33706

[21] Appl. No.: 573,887

[22] Filed: Dec. 18, 1995

[51] Int. Cl.[6] ..... A63B 53/04

[52] U.S. Cl. ..... 473/252; 473/242

[58] Field of Search ..... 473/252, 253, 473/254, 242

[56] References Cited

U.S. PATENT DOCUMENTS

| | | | |
|---|---|---|---|
| 1,631,504 | 6/1927 | Redman | 473/252 |
| 2,820,638 | 1/1958 | Morrison | 473/252 |
| 3,035,839 | 5/1962 | Coglianese | 473/242 |
| 3,955,819 | 5/1976 | Yokich | 473/252 |
| 4,128,244 | 12/1978 | Duclos | 473/252 |
| 4,834,387 | 5/1989 | Waites et al. | 473/252 |
| 4,986,544 | 1/1991 | Benson | 473/254 |
| 5,273,282 | 12/1993 | Cannon | 473/252 |
| 5,558,332 | 9/1996 | Cook | 473/252 |

*Primary Examiner*—Marks S. Graham

[57] ABSTRACT

Golf club sight alignment device comprising a plurality of rectilinear slots or grooves disposed in the top surface of the club head from the face to the back of the club head at predetermined angles of incidence to the bottom of the club head and having predetermined depth and width such that one holding the golf club can correctly position the golf club by visually perceiving the light reflected from the bottoms of the grooves or slots at maximum visual acuity to ascertain when the club is correctly positioned for striking a golf ball.

13 Claims, 5 Drawing Sheets

GOLF CLUB VISUAL ALIGNMENT MEANS

BACKGROUND

1. Field of Invention

This invention relates to golf clubs and more specifically to golf clubs used for putting having a device which will indicate to the golfer when his eye and body is in proper angular position in relation to the head of the golf club.

2. Description of Prior Art

Those who have played the game of golf are well aware that putting often accounts for nearly half the golfer's total score. Although there are a wide variety of putters available to golfers, they still seek improved designs that will assist them in lowering their total score. There are two skills which a golfer must develop in order to putt a golf ball with the consistency and accuracy required for a good round of golf. First, the golfer must develop an ability to estimate both a target line and an initial speed for the ball which will cause it to travel across the putting surface and fall into the hole. Second, the golfer must develop an ability to consistently aim the putter and strike the ball so that it will depart the putter very nearly along the target line and very nearly at the correct initial speed. Relatively minor putter aiming errors and initial ball speed errors can result in badly missed putts.

While natural ability and practice are required in order for a golfer to fully develop these two skills, it is very helpful for him to use a putter which provides visual alignment feedback during address, during aiming, and during the back swing and putting strokes. Undetected errors in positioning and alignment of the putter head during any of these phases of putting can cause the golfer to miss putts, make erroneous aiming compensations, and prolong or make impossible full development of his natural abilities. That designers have long recognized this fact is evidence by the numerous examples of putter configurations and putter design schemes in the patent literature.

In general, for prior art putters, design features intended to assist the golfer in aiming, positioning and stroking the putter may be grouped into one or more of the following categories:

(a) Designs intended to help the golfer aim the putter. When a putter is properly aimed, the target line and an intersecting line drawn normal to the putter's striking face defines a vertical plane.

(b) Designs intended to help the golfer position the putter head for the correct angle of lie. When a putter is positioned at the design angle of lie for his club, a line drawn normal to the striking face and an intersecting longitudinal axis of the club head defines a vertical plane.

(c) Designs intended to help the golfer position the putter head for the correct angle of loft. When a putter is positioned at the design angle of loft for the club, a line drawn normal to the striking face is inclined to the horizontal at the design angle of loft of the striking face.

(d) Designs intended to help the golfer position the putter club head laterally relative to the fall.

(e) Designs which comprise putter head weight distribution schemes to help the golfer avoid introducing putter head rotational error due to inertial effects during the back swing and putting strokes.

When using certain golf clubs, especially the putter, it is well recognized by the authorities that the eye of the golfer should be directly over the part of the club head which is to contact the ball. This helps the golfer to draw a correct imaginary line of flight from the ball to the cup, and to move the club head along that line.

When using clubs other than the putter, the eye should be in a different angular relation, but still there is a preferred angular position of the eye relative to the head of the golf club.

Design Pat. Nos. Des. 333,3332 to McCabe et al, Feb. 16, 1993 and Des. 218,108 to Henry W. Wegener, Jr., Jul. 21, 1970 disclose lines or marking on the club which are aligned with the axis of the club to help one align the ball with the club head.

Apparatus U.S. Pat. No. 2,929,631, Mar. 22, 1960, to J. W. Gillon discloses a golf club with an angle of view indicator in the form of a lens incorporated into the top of the club head which permits the user to see different colors depending upon where his eyes are with respect to the club head.

U.S. Pat. No. 4,986,544 to Glenn S. Benson, dated Jan. 22, 1991 discloses yet another way to align a putter head which has colored strips on either side of a visual indicator block.

While each golfer tends to possess his own unique style of putting, two basic fundamentals are, with few exceptions, practiced by those who have mastered this aspect of the game. The first fundamental is the proper position of the eyes during the stroke, that is, centered directly over the ball. The second fundamental is the proper positioning of the putter with the sole resting flat on, or slightly above, the putting surface.

Prior putters have, for the most part, failed to assist the golfer in practicing these basic fundamentals, instead concentrating on putter alignment, and heel and toe weighing to counter off-center hits.

SUMMARY OF THE INVENTION

The putter of this invention provides for visual confirmation of the proper positioning of the golfer's head and also that the club has been properly soled at address. The present invention provides the head of the club with an optical device which gives to the golfer an optical indication when his eye is in proper angular relation with the topical device.

Rectilinear grooves are located on the upper surface of the club near the toe of the club and the heel of the club. The bottom of the grooves are colored with an iridescence color which, when the head of the user of the club is in the correct position over the club, he will be able to see the brilliance of the color from the grooves equally. This assures the user that his head is properly aligned over the club head.

Accordingly, it is an object of this invention to provide a simple structure which enables the user of a golf club to visually perceive when his head and body is correctly aligned to the club head. The golfer may then align the face of the club with the ball to obtain the correct or desired line of travel for the ball.

BRIEF DESCRIPTION OF THE DRAWINGS

These, as well as further objects and advantages of the invention, will become apparent to those skilled in the art from a review of the following detailed specification of my invention, reference being made to the accompanying drawings in which.

DETAILED DESCRIPTION OF THE PREFERRED EMBODIMENT

The preferred embodiment herein described is not intended to be exhaustive or to limit the invention to the precise form disclosed. It is chosen and described to explain the principles of the invention and its application and practical use to enable others skilled in the art to utilize its teachings. Although the invention is disclosed for use by a right handed golfer, it is intended that the embodiment may be reversed for use by a left handed golfer.

Referring now more particularly to the drawings, wherein like numerals represent like elements throughout the specification.

Figure 1:
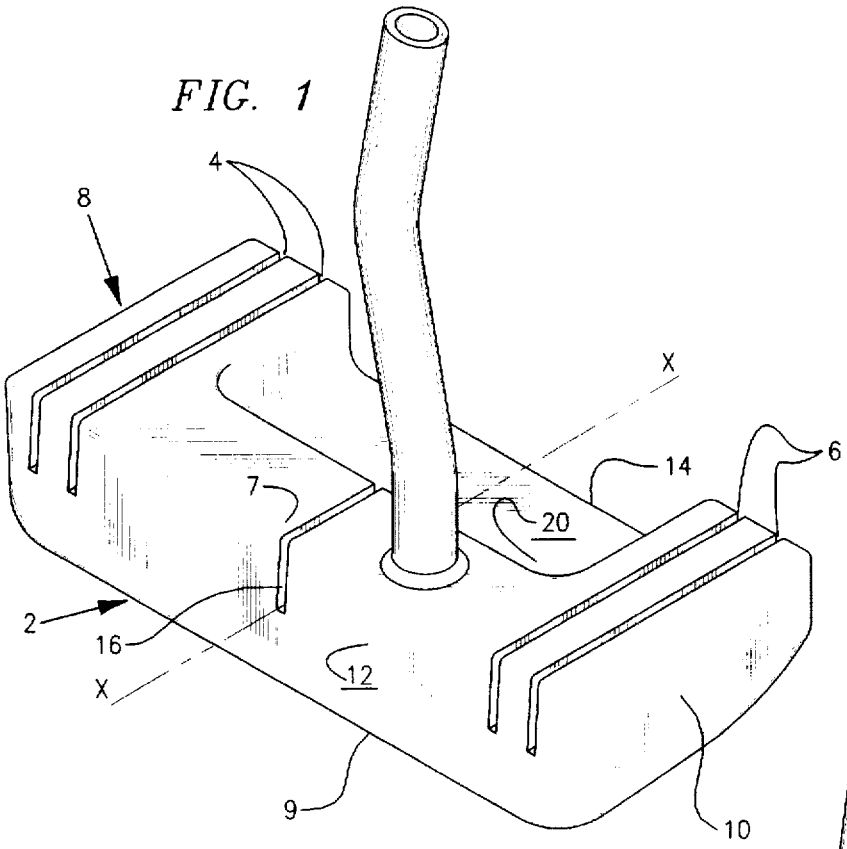
FIG. 1 is a diagrammatical front perspective view of the putter head in accordance with the present invention.

Referring now to FIG. 1, the present sight alignment means is shown on the golf club head 2. Rectilinear grooves or slots 4 are disposed into top 7 near toe 8 while rectilinear grooves 6 are disposed near heel 10 of the club head 2. The sight alignment means may also comprise a slot or groove 16 which also aids the golfer to align the club head for optimum use. The grooves extend from a point at or near the face 12 of the golf club head to a point at or near the back 14 of said golf club head 2 and parallel with the longitudinal axis x-x of the golf club head from the face 12 of the club head to rear 14 of the club head. The longitudinal axis x-x represents the center of impact of the golf club head and the line along which the golf ball should be struck when bottom 9 is substantially parallel with the plane under the golf ball.

Figure 2:
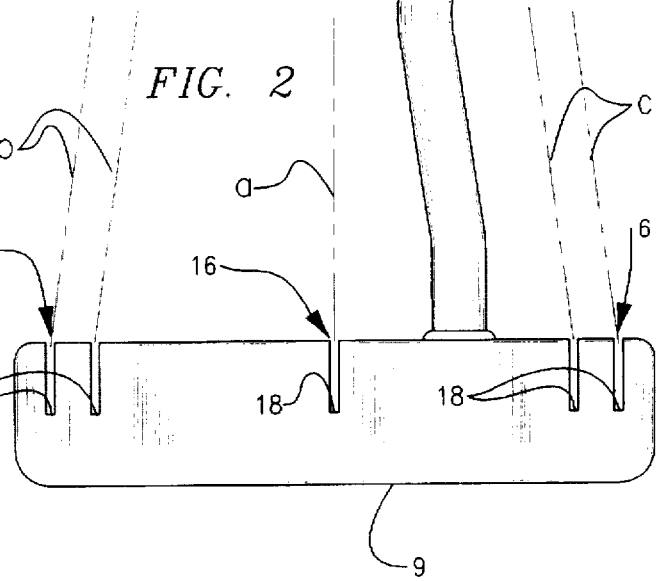
FIG. 2 is a front view of the putter head shown in FIG. 1.
Figure 3:
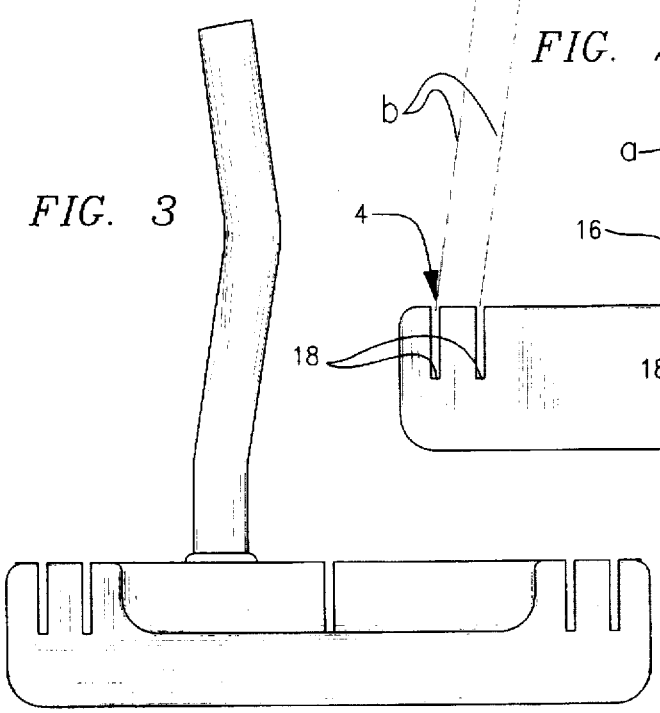
FIG. 3 is a rear view of the putter head shown in FIG. 1.
Figure 4:
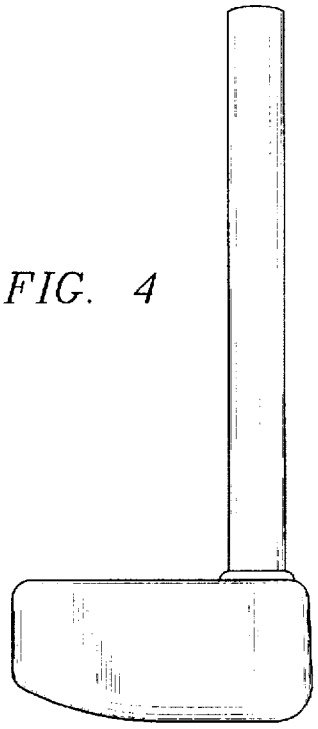
FIG. 4 is a left side view of the putter head.
Figure 5:
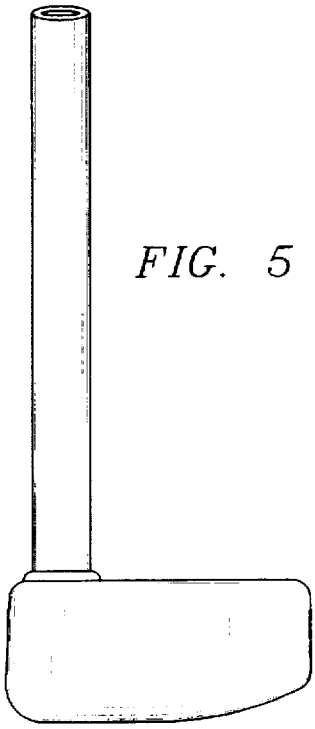
FIG. 5 is a right side view of the putter head.

In a preferred embodiment, the grooves are approximately 1/16 of an inch in width and ½ inch deep. The grooves 4 and 6 have a longitudinal axis that extends from a point at or near the face 12 of the golf club head 2 to a point at or near the rear 14 of the golf club head 2. Grooves 4 and 6 also have longitudinal axes which are co-extensive with the length of said grooves from this face 12 to rear 14 of the golf club head 2. As shown in FIG. 2, the grooves have planar bottoms 18 which are coated with a color contrasting with the color of the golf club head. Referring to FIG. 1, a putter head is normally one inch thick from top to bottom, 4 inches long from heel 6 to toe 10 and 2 inches wide from club face 12 to the back of club 2 and weighs 10 to 12 ounces. The amount of mass removed due to grooves 4 and 6 is, of course, a function of the dimensions of the grooves. The golf club head may also be matched or machined to achieve a desired finished weight. The club head as shown has a recess 20 in the rear portion which also contributes to the overall weight of the club head. The club head may have a balanced weight from heel to toe by the number of grooves utilized and the amount of material removed in recess 20 such that the club is equally weighted heel to toe.

The club head also has a groove 16 which is at the center of the club head, midway between heel 10 and toe 8 and at the center of impact of the club head. This is to enable the user to know where the middle of the club head is located so that he may align this point with the ball to establish a line of sight between the ball and the intended target.

The user of the club would first use the sight alignment means to establish that his head is directly over club head 2 and then align the club face 12 with the ball to establish a line between the ball and the target. If the club is not a putter, the eye of the golfer would not be directly above the golf club center of impact but would be aligned at angles which vary with the particular club being used. The eye of the golfer would be directly above a putter and substantially away from "vertically above" the club when using a driver or wood. The present alignment device will permit the user to be properly positioned with respect to the particular club head so that the sole or bottom of the club head is parallel with the ground when correctly aligned. All the golfer has to do is position the golf club until the golfer perceives maximum color from the grooves, align the face of the club with the direction he wishes the ball to travel and to then strike the ball while maintaining correct positional displacement from and with the golf ball.

Figure 6:
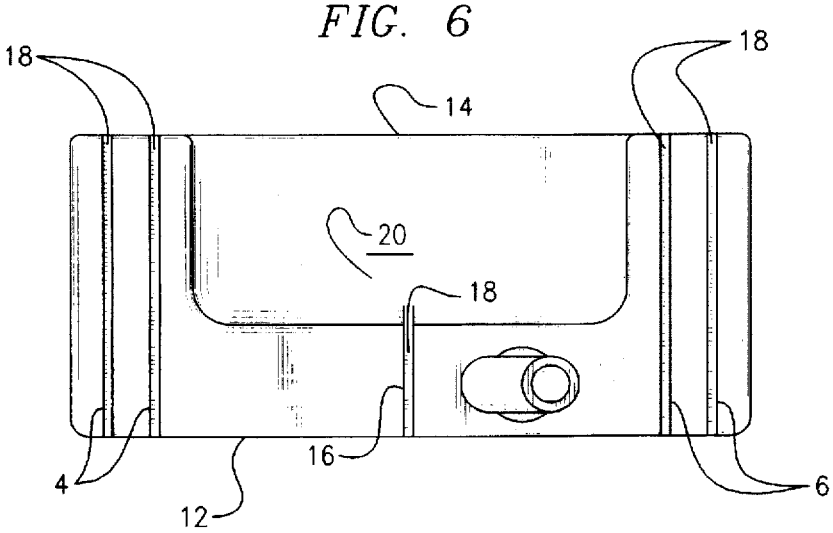
FIG. 6 is a top view of the putter head.
Figure 7:
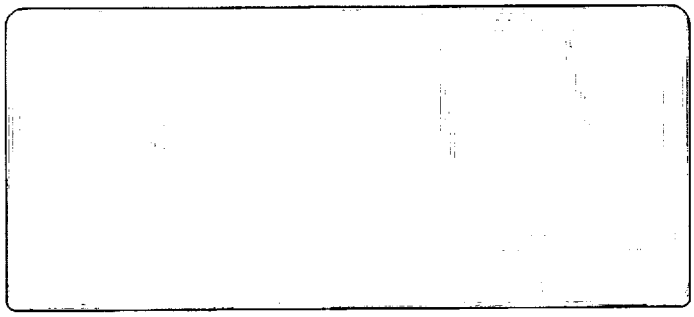
FIG. 7 is a bottom view of the putter head.

Referring to FIGS. 2 and 6, the planar bottom surface 18 of grooves 6, 4 and 16 are colored, preferably with a vinyl, iridescent covering. In a preferred embodiment, I have found a bright yellow to be desirable while other colors may likewise be utilized. The colored surfaces are also disclosed in the top view of the club head disclosed in FIG. 6.

When the user's head is properly positioned to the golf club head, the user will see into the grooves and see the planar bottoms 18. The colored bottom portions of the grooves will intensify when the user's head is appropriately positioned. When the club is rocked or moved from heel to toe or from toe to heel, then the intensity of the light perceived from the grooves will vary. The perception will vary from very bright when correctly viewed to a muted, subdued perception, to none at all if the angle of visual perception is such that one may not see the bottom of the grooves at all.

A golfer may quickly learn the method of use of the club alignment means by moving the shaft of the club to and away from his person to thus cause the intensity of the light perceived from the bottom of the grooves to vary from none to maximum to none as the club head is rotated from one extreme to the other.

Figure 8:
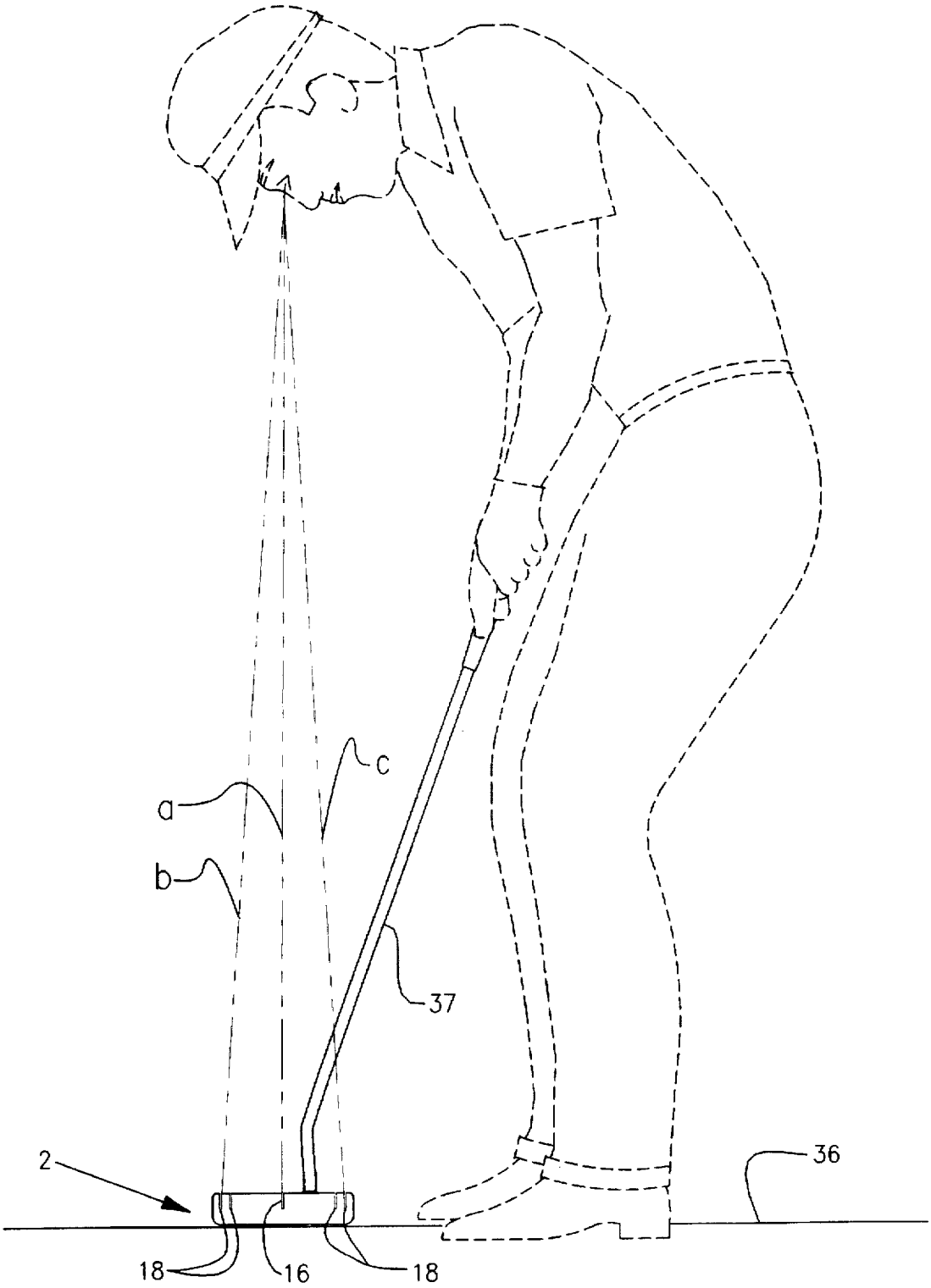
FIG. 8 is a diagram of an individual using the golf club equipped with the present invention.

Referring to FIG. 8, an individual is shown holding putter head 2. As one looks down at the putter head, the field of view of the user has a narrow tolerance within which he can see bottoms 18 of grooves 4, 6 and 16 because of the depth and the width of the grooves. When the user can see the bottoms of the grooves, the color disposed on the bottom of the grooves (FIG. 6, reference numeral 18), will appear at its brightest to indicate that the user's head is over the center of the club head and his body is in the correct position and posture. When the golfer uses this particular invention, it causes him to assume the correct position as to the ball and to also assume the correct posture for striking the ball.

If the grooves at toe 8 and at heel 10 are placed closer together, then the field of view in which the user can see the bottom of all grooves is increased. We can say that the tolerance in increased. Conversely, as the grooves are separated more, we can say that the tolerance is decreased.

FIG. 8 discloses an individual as he addresses the ball which is not shown in the figure. When the head of the user is directly over the club head, his eyes will be directly above groove 16 as shown by line of sight "a". At the same time, his line of sight to the toe of the club is as shown by line of sight "b" and his line of sight to the heel of the club head is shown by line of sight "c". If the user leans or steps forward or backward, the intensity of the light reflected or viewed from grooves at the heel and toe will vary. When the colors are at their brightest, the proper positioning of the user's head over the club head is achieved. He may then determine the line along which he wishes to have the ball travel.

Conversely, the user may first align the club head with the ball and the cup or desired destination of the ball and then look to determine the proper alignment of his head over the club and thus the golfer assumes the correct body arm and hand positions.

The invention disclosed herein may be used on any club. The placement of the grooves and the angle at which the groove enters the club head will vary so that the user will see the color at its brightest when his head and body are appropriately aligned.

Figure 9:
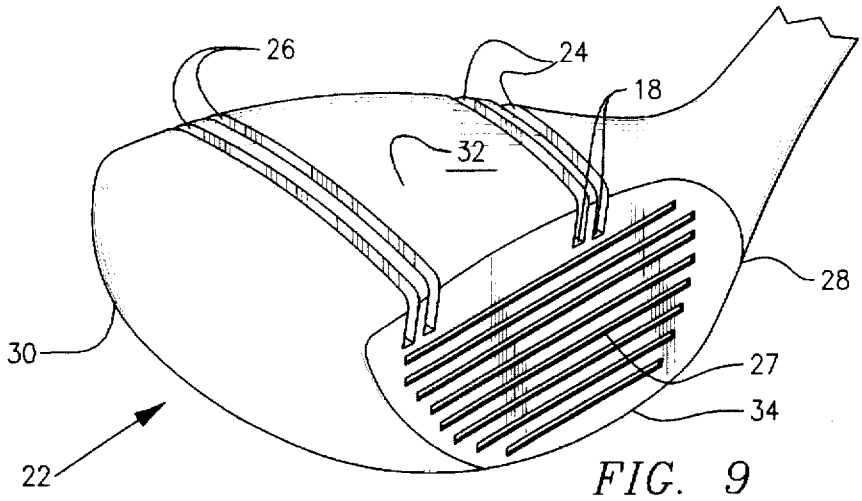
FIG. 9 is a perspective view of a golf club head referred to as a driver or a wood.
Figure 10:
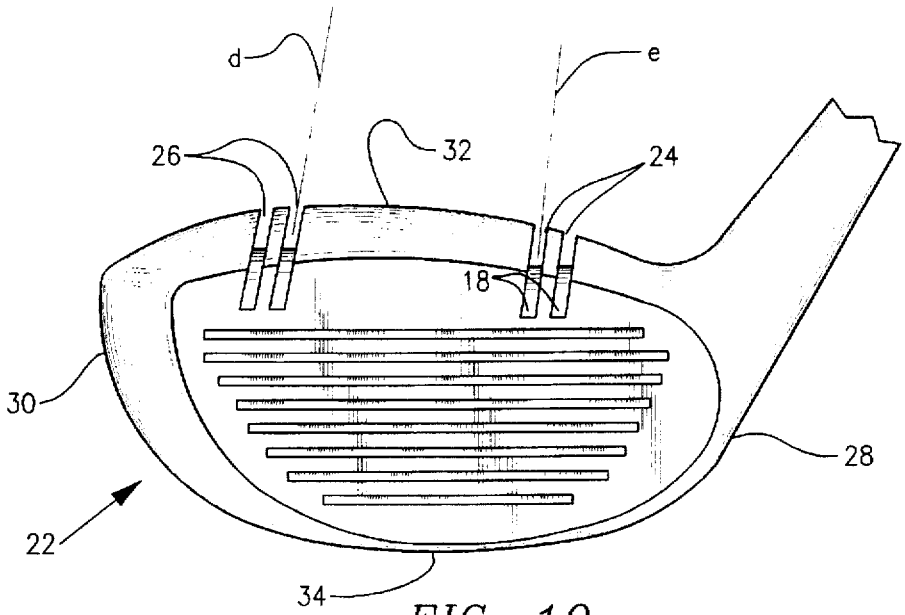
FIG. 10 is a front view of the club head disclosed in FIG. 9 showing the face of the club head.

FIG. 9 and FIG. 10 disclose what is conventionally referred to as a "wood" or "driver" depending upon the particular configuration or pitch of the club head. FIG. 9 shows a golf club head 22 which has grooves 24 located near heel 28 and grooves 26 located near toe 30 of the club head. The grooves are on either side of the center of impact 27 where it is most desirable that the club face strike the golf ball. The grooves are disposed into the topmost surface of the club head at an angle which is determined by the particular configuration of the club head and the length of the handle so that the club is correctly positioned for use when the color on bottom 18 of the grooves is perceived at maximum intensity. The angle of the grooves determines where the club head would need to be placed in front of the user so that it is correctly aligned or placed for use. The lines of sight from the user are shown as "d" and "e" as previously discussed with regard to FIG. 8. When the club head is correctly positioned, the user would see the color disposed at the bottom of the grooves at maximum intensity.

Figure 11:
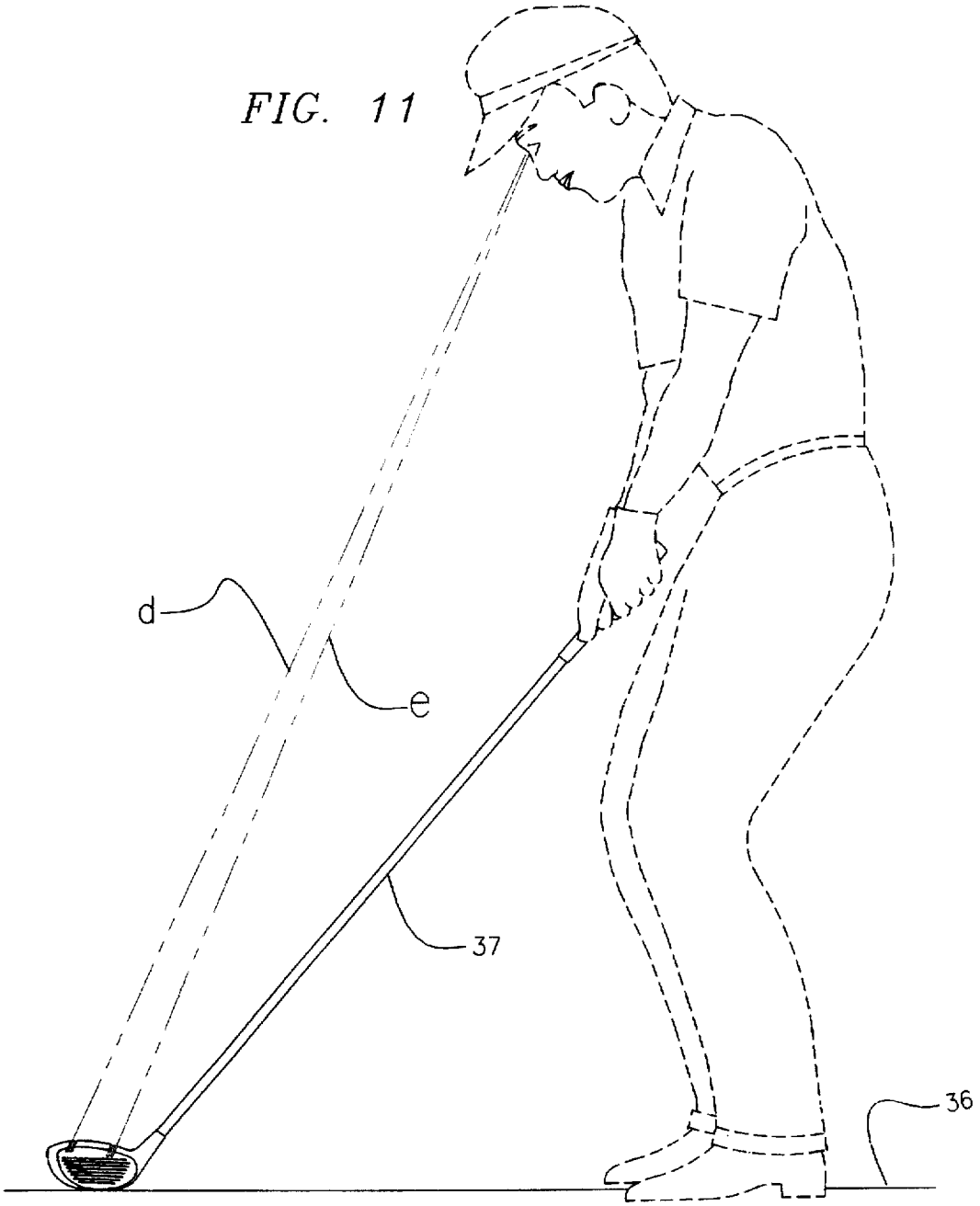
FIG. 11 is a diagrammatical drawing showing a golfer addressing the golf ball with a wood or driver.
Figure 12:
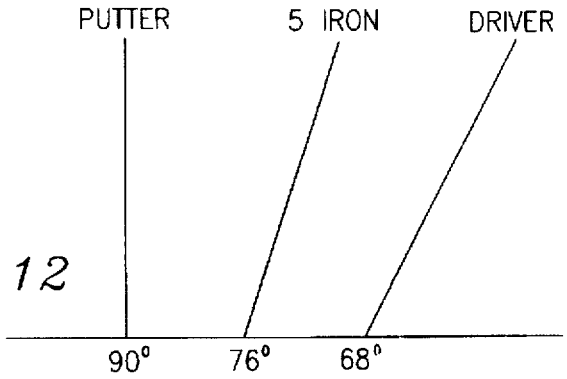
FIG. 12 is a diagram showing the different angles at which a golfer would view a putter, a five-iron and a driver or wood.

Referring to FIGS. 8 and 11, it can be appreciated that the position of the club to the user of a golf club putter as shown in FIG. 8 is different from the position of the club to the golfer or user of other golf clubs as shown in FIG. 11 whether irons or woods as shown in FIG. 12. FIG. 8 shows a putter which traditionally requires the head of the user to be directly above the head of the club. FIG. 11 shows a wood and a desired position for the user. As is well known in the art of golfing, but very difficult to achieve, the golf club should be held at a particular angle in relation to the golfer so that the bottom of the club is substantially parallel with the surface upon which the golf ball is lying. Assuming the ground is level, the plane upon which the golf ball would reside would be as shown as 36 in FIGS. 8 and 11. Thus, the objective of the golfer is to cause the golf club head to be perfectly aligned between his person and the ground. By placing the sight alignment means' grooves into the topmost surface of the club head at predetermined angles, the user will see the bottom of the grooves when the club head in parallel with the ground and at the proper distance from the golfer for that particular club, whether it be a putter, a driver or a five iron. As one may cause the club shaft 37 to be raised or lowered, the eye will detect different intensities of the color perceived, if any, by the golfer. As one so positions the shaft and thus the club head, the eye may visually perceive the color on the planar bottoms of the grooves. When the color is maximized, then the club is in the correct position for use.

The grooves or slots 24 and 26 shown in FIGS. 9 and 10 are cut or disposed into the top 32 of the club head at predetermined angles of incidence with respect to the bottom of the club which is the same as the plane upon which bottom 34 mandates when the club is in the correct position for striking a golf ball. This plane is generally shown as 36 in FIGS. 8 and 11. For a putter it would be the same; see FIG. 8 wherein the plane would be the same as the bottom of the club.

Figure 10A:
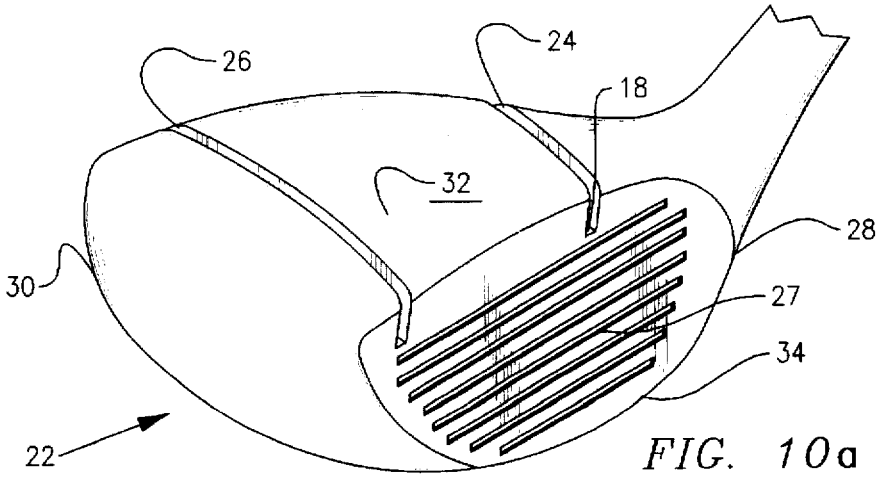
FIG. 10*a* is a front view of the club head showing a different arrangement of the slots and grooves.

It can be appreciated that the grooves 24 and 26 may actually be only a single groove instead of a pair of grooves as shown in FIG. 10*a*. Like numerals are used in this FIG. as when discussing FIG. 9. The difference lies in the use of a single groove instead of a pair of grooves.

Referring to FIG. 12, it has been determined that the angle of incidence of the slots or grooves will be 90 degrees for a putter and approximately 68 degrees for a driver. A five-iron would be at 76 degrees. When the user places the club in front of him/her and moves the club toward and away from his/her person, the visual acuity of the light seen from the bottom of the grooves will be seen at its brightest when the club head is correctly positioned. The angles at which the slots are predisposed will vary depending on the number of the wood with the degree of the angle of the slot increasing from 68 degrees for a driver toward 90 degrees for a number 9 wood.

Although the invention has been described with reference to a specific embodiment, this description is not meant to be construed in a limiting sense. On the contrary, various modifications of the disclosed embodiments will become apparent to those skilled in the art upon reference to the description of the invention. It is, therefore, contemplated that the appended claims will cover such modifications, alternatives, and equivalents that fall within the true spirit and scope of the invention.

I claim:

1. A golf club having a golf club head comprising:

a toe, a heel, a top, a bottom, a face, a back, a center of impact intermediate said toe and said heel, and a sight alignment means set into said top of said golf club head for visual indication to a user as to when the golf club is in proper angular position in relation to the body of the user, said sight alignment means comprising:

a plurality of rectilinear grooves positioned into said top of said golf club head, said rectilinear grooves being open through said top of said golf club head and having bottoms which provide a changing optical indication with a change of angle of view;

said grooves being so constructed and arranged that said grooves provide an optical indication to the eyes of the user when the body of said user is properly aligned with said golf club and on said center of impact to thus indicate that the golf club is in the optimum position in relation to the body of the user for successfully striking a golf ball, wherein the bottom of each said groove is colored and wherein said slots are positioned into said golf club head at predetermined angles with respect to the bottom of said golf club head such that the user will see said color at optimum intensity when the user's head is correctly aligned with respect to the golf club head for striking the golf ball wherein, said golf club head has a longitudinal axis extending from said face of said club head to said rear of said club head and through said center of impact intermediate said toe and said heel, wherein said grooves extend from said face of said club head toward said back of said club head and in longitudinal alignment with said longitudinal axis from said face of said club head to said rear of said club head along which a golf ball should be struck, wherein said golf club head is a driver and wherein said grooves are disposed at 68 degrees with respect to the plane of the bottom of said golf club head.

2. A golf club having a golf club head consisting of:

a toe, a heel, a top, a bottom, a face, a back, a center of impact intermediate said toe and said heel, and a sight alignment means set into said top of said golf club head for visual indication to a user as to when the golf club is in proper angular position in relation to the body of the user, said sight alignment means comprising:

a plurality of rectilinear grooves positioned into said top of said golf club head, said rectilinear grooves being open through said top of said golf club head and having bottoms which provide a changing optical indication with a change of angle of view;

said grooves being so constructed and arranged that said grooves provide an optical indication to the eyes of the user when the body of said user is properly aligned with said golf club and said center of impact to thus indicate that the golf club is in the optimum position in relation to the body of the user for successfully striking a golf ball, and wherein said golf club head is a driver and wherein said grooves are disposed at 68 degrees with respect to the plane of the bottom of said golf club head.

3. A golf club as set forth in claim 2 wherein the bottom of each said groove is colored and wherein said slots are positioned into said golf club head at predetermined angles with respect to the bottom of said golf club head such that the user will see said color at optimum intensity when his head is correctly aligned with respect to the golf club head for striking a golf ball.

4. A golf club head as set forth in claim 2 wherein said golf club head has a longitudinal axis extending from said face of said club head to said rear of said club head and through said center of impact intermediate said toe and said heel, wherein said grooves extend from said face of said club head toward said back of said club head and in longitudinal alignment with said longitudinal axis from said face of said club head to said rear of said club head along which a golf ball should be struck.

5. A golf club as set forth in claim 2 wherein at least two said grooves are positioned between said center of impact and said toe of said golf club head and at least two said grooves are positioned between said center of impact and said heel of said golf club head.

6. A golf club as set forth in claim 4 wherein at least one said groove is positioned between said center of impact and said toe of said golf club head and at least one said groove is positioned between said center of impact and said heel of said golf club head.

7. A golf club as set forth in claim 2 wherein the sight alignment means also causes the user of the said golf club to have the proper posture for striking a golf ball.

8. An elongated golf club head having a toe, a heel, a top, a bottom, a front, a back and a center of impact intermediate said toe and said heel;

the club head having a topmost surface adapted to be substantially level with the ground when the club is held in playing position;

said club head comprising an optical alignment device set into said topmost surface of said club head for visual indication to the user as to when said golf club is in the proper angular position in relation to the body of the user;

said optical alignment device having a center aligned with said center of impact of said club head, and being level with the ground when said club is held in playing position;

said optical alignment device comprising a plurality of grooves disposed into said topmost surface of said club head at predetermined angles in relationship to the said bottom of said club, said grooves having a length from the front of said club head to said back of said club head and having planar bottoms at a predetermined depth below said topmost surface of said club head which display a color in contrast to the color of said golf club head;

the grooves being constructed and arranged so that when the eye of the user is aligned with the longitudinal center of said club head and when the body of the user of the club is properly aligned with said golf club, the golfer will see the color at the bottom of all grooves at maximum intensity and when the user's body is not in the correct relationship to the golf club, the user will see a muted color or no color at all in the optical alignment device and wherein said grooves are 1/16 of an inch in width and ½ inch deep.

9. An elongated golf club putter head having a toe, a heel, a top, a bottom, a front, a back and a center of impact intermediate said toe and said heel, said the club putter head having a topmost surface adapted to be level with the ground when an attached putter is held in playing position and comprising; an optical alignment device set into said topmost surface of said club putter head for visual indication to a user as to when said golf club is in the proper angular position in relation to the body of the user;

said optical alignment device having a center aligned with said center of impact of said club putter head, and being level with the ground when the putter is held in playing position;

said optical alignment device comprising a plurality of grooves disposed into said topmost surface of said club putter head, said grooves having a length from the front of said club putter head to said back of said club putter head and having planar bottoms that display a color in contrast to the color of said golf club head;

the groove being constructed and arranged so that when the eye of the user is aligned vertically above the longitudinal center of said club putter head, the golfer will see the color at the bottom of all grooves at maximum intensity when the body of said user is properly aligned with said golf club to thus indicate that the golf club is in the optimum position in relation to the body of the user for successfully striking a golf ball and when the user's head is substantially displaced from said center, the user will perceive a muted color or no color at all in the optical alignment device, wherein said grooves are no more than 1/16 of an inch in width and at least ½ inch deep.

10. An elongated golf club putter head as set forth in claim 9 wherein said grooves extend through said face of said putter head and through said back of said putter head.

11. A golf club having a golf club head comprising:

a toe, a heel, a top, a bottom, a face, a back, a center of impact intermediate said toe and said heel, and a sight alignment means set into said top of said golf club head for visual indication to a user as to when the golf club is in proper angular position in relation to the body of the user, said sight alignment means comprising:

a plurality of rectilinear grooves positioned into said top of said golf club head, said rectilinear grooves being open through said top of said golf club head and having bottoms which provide a changing optical indication with a change of angle of view;

said grooves being so constructed and arranged that said grooves provide an optical indication to the eyes of the user when the body of said user is properly aligned with said golf club and on said center of impact to thus indicate that the golf club is in the optimum position in relation to the body of the user for successfully striking a golf ball, wherein the bottom of each said groove is colored and wherein said slots are positioned into said golf club head at predetermined angles with respect to the bottom of said golf club head such that the user will see said color at optimum intensity when the user's head is correctly aligned with respect to the golf club head for striking the golf ball wherein, said golf club head has a longitudinal axis extending from said face of said club head to said rear of said club head and through said center of impact intermediate said toe and said heel, wherein said grooves extend from said face of said club head toward said back of said club head and in longitudinal alignment with said longitudinal axis from said face of said club head to said rear of said club head along which a golf ball should be struck, wherein said golf club head is a golf club putter and wherein said grooves are disposed at 90 degree angles with respect to said bottom of said golf club head and, wherein said grooves are 1/16 of an inch in width and 1/2 inch deep.

12. A golf club as set forth in claim 11 wherein said grooves extend through said face of said club head and through said back of said club head.

13. A golf club as set forth in claim 12 wherein said bottoms of said grooves are iridescent yellow.

* * * * *